US008944848B1

(12) United States Patent
Yu et al.

(10) Patent No.: US 8,944,848 B1
(45) Date of Patent: Feb. 3, 2015

(54) ELECTRICAL CONNECTOR WITH IMPROVED HIGH FREQUENCY SIGNAL TRANSMISSION ENVIRONMENT

(71) Applicant: Hon Hai Precision Industry Co., Ltd., New Taipei (TW)

(72) Inventors: Chun-Ming Yu, Kunshan (CN); Ji-Chao Wang, Kunshan (CN); Guo-Hua Zhang, Kunshan (CN); Chien-Ping Kao, Hershey, PA (US); Xiao-Qin Zheng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 7 days.

(21) Appl. No.: 13/949,264

(22) Filed: Jul. 24, 2013

(51) Int. Cl.
*H01R 13/648* (2006.01)
*H01R 13/6471* (2011.01)

(52) U.S. Cl.
CPC ..... *H01R 13/6471* (2013.01)
USPC ..... 439/607.01

(58) Field of Classification Search
CPC ..... H01R 13/65802; H01R 23/7073
USPC ..... 439/607.01, 607.11, 607.13
See application file for complete search history.

(56) References Cited

U.S. PATENT DOCUMENTS

| | | | | |
|---|---|---|---|---|
| 6,093,060 | A * | 7/2000 | Wiebking et al. | 439/676 |
| 7,008,261 | B2 * | 3/2006 | Xue et al. | 439/541.5 |
| 7,789,706 | B2 * | 9/2010 | Chen et al. | 439/607.35 |
| 7,887,370 | B2 * | 2/2011 | Chen et al. | 439/607.35 |
| 8,388,372 | B2 | 3/2013 | He | |
| 8,636,546 | B2 * | 1/2014 | He et al. | 439/607.4 |

* cited by examiner

*Primary Examiner* — Phuongchi T Nguyen
(74) *Attorney, Agent, or Firm* — Wei Te Chung; Ming Chieh Chang

(57) ABSTRACT

An electrical connector comprises an insulative housing, a plurality of contacts retained in the insulative housing and including a grounding contact and a first pair of differential signal contacts. The first pair of differential signal contacts have a first signal contact and a second signal contact closing to the grounding contact. Each contact has a contacting portion, a soldering portion, a position portion and a connecting portion. A first distance is defined between a center line of the grounding contact and an inner side edge of the connecting portion of the second signal contact, a second distance is defined between the center line and an inner side edge of the soldering portion, and a third distance is defined between the center line and the position portion, the second distance and the third distance are both smaller than the first distance.

19 Claims, 6 Drawing Sheets

ELECTRICAL CONNECTOR WITH IMPROVED HIGH FREQUENCY SIGNAL TRANSMISSION ENVIRONMENT

BACKGROUND OF THE INVENTION

1. Field of the Invention

The present invention relates to electrical connectors, more particularly to electrical connectors with improved high frequency signal transmission environment.

2. Description of Related Art

An USB 3.0 connector usually includes an insulative housing and a plurality of contacts retained therein. The contacts include a plurality of pairs of differential signal contacts and a grounding contact between adjacent two pairs of said differential signal contacts. Such as an electrical connector shown in U.S. Pat. No. 8,388,372, conjoined with its FIG. 5, each contact has a horizontal position portion, a soldering portion and a connecting portion connecting with the position portion and the soldering portion. Wherein a distance between the connecting portion of the grounding contact and an adjacent signal contact is same as that of the soldering portion and the position portion of the two contacts. In this arrangement, the contacts can being easily produced.

As we know, the electrical connector trends to miniature and have a high signal transmission speed, thereby the contacts in USB 3.0 connector have a close arrangement with equal distance therebetween so as to occupy a small area, and the USB 3.0 connector standardized at the end of 2008 each has a speed rate of up to 5 Gb/s to satisfy the high signal transmission. However, the close arrangement between adjacent two pairs of differential signal contacts in the high frequency connector easily causes a high crosstalk therebetween, and the crosstalk has a bad influence to the high frequency signal transmission and make the connectors can not reach an expected high signal transmission speed.

Hence, an improved electrical connector is desired to overcome the above problems.

BRIEF SUMMARY OF THE INVENTION

According to one aspect of the present invention, an electrical connector comprises: an insulative housing defining a mating port with a first tongue extending thereinto and a base portion assisting the first tongue, the base portion having a bottom wall, a plurality of contacts retained in the insulative housing, the contacts have a first grounding contact and a first pair of differential signal contacts, the first pair of differential signal contacts have a first signal contact and a second signal contact located between the first signal contact and the first grounding contact, each contact having a contacting portion extending into the mating port, a soldering portion extending downwardly beyond the bottom wall, a position portion extending backwardly from the contacting portion and a connecting portion vertically bending from the position portion and located at a back side of the insulative housing, all the contacting portions disposed in an equal interval while the all soldering portions optionally disposed in a non-equal interval under condition that the distance between the soldering portions of the grounding contact and the signal contact is larger than that between the soldering portions of the pair of differential signal contacts; wherein a first distance is defined between a center line of the first grounding contact and an inner side edge of the connecting portion of the second signal contact, a second distance is defined between the center line and an inner side edge of the soldering portion of the second signal contact, and a third distance is defined between the center line and the position portion of the second signal contact, and the second distance and the third distance are both narrower than the first distance.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
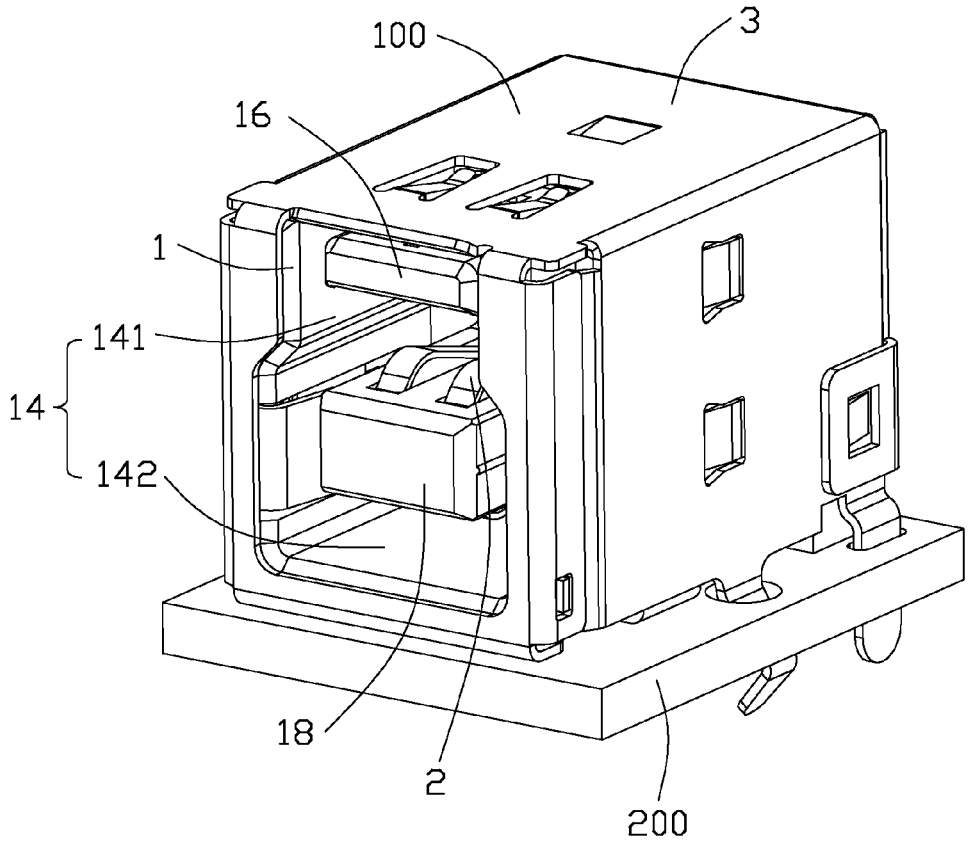
FIG. 1 is an assembled perspective view of an electrical connector mounted to a circuit board according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
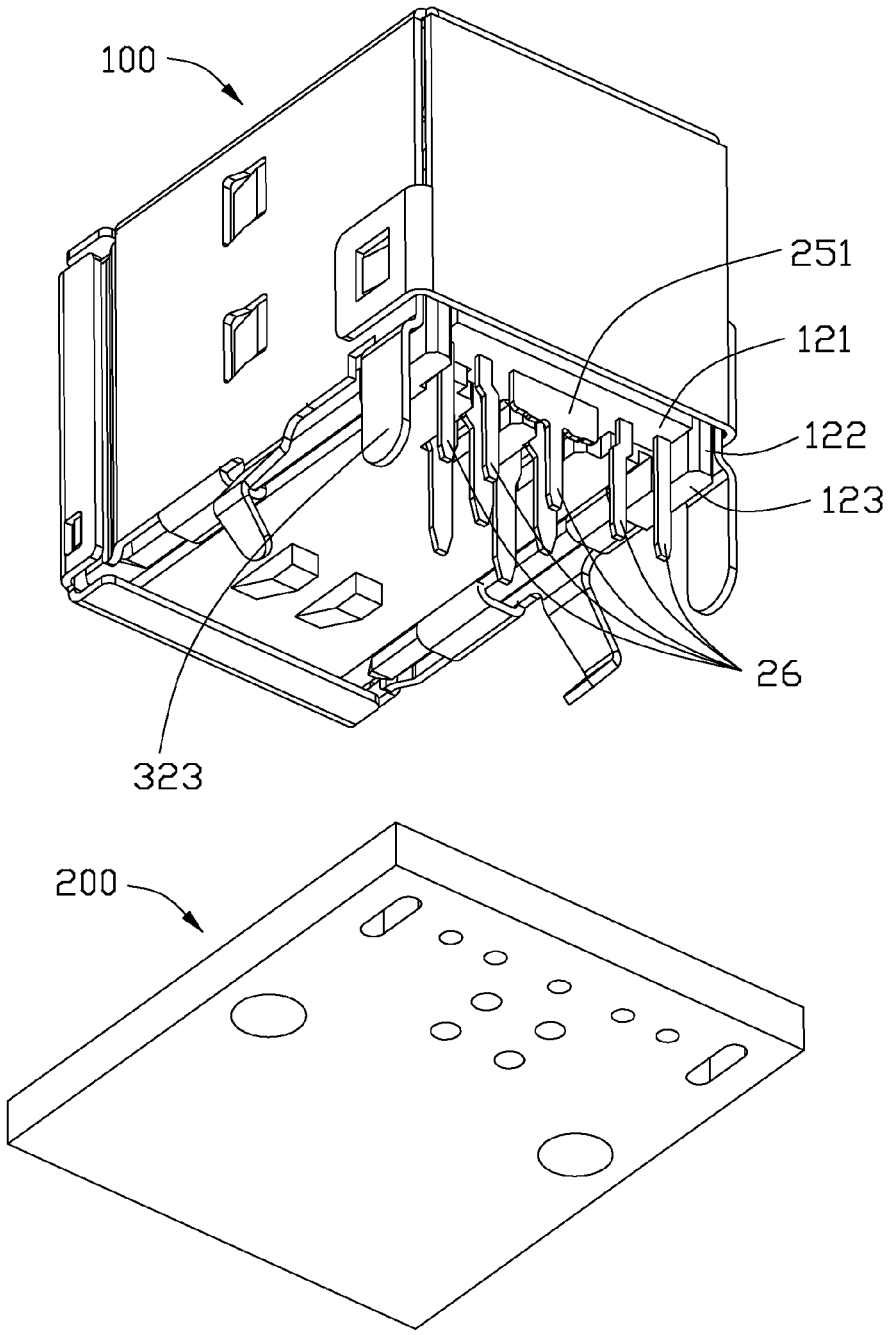
FIG. 2 is a perspective view of the electrical connector separated from the circuit board according to the present invention.
Figure 3:
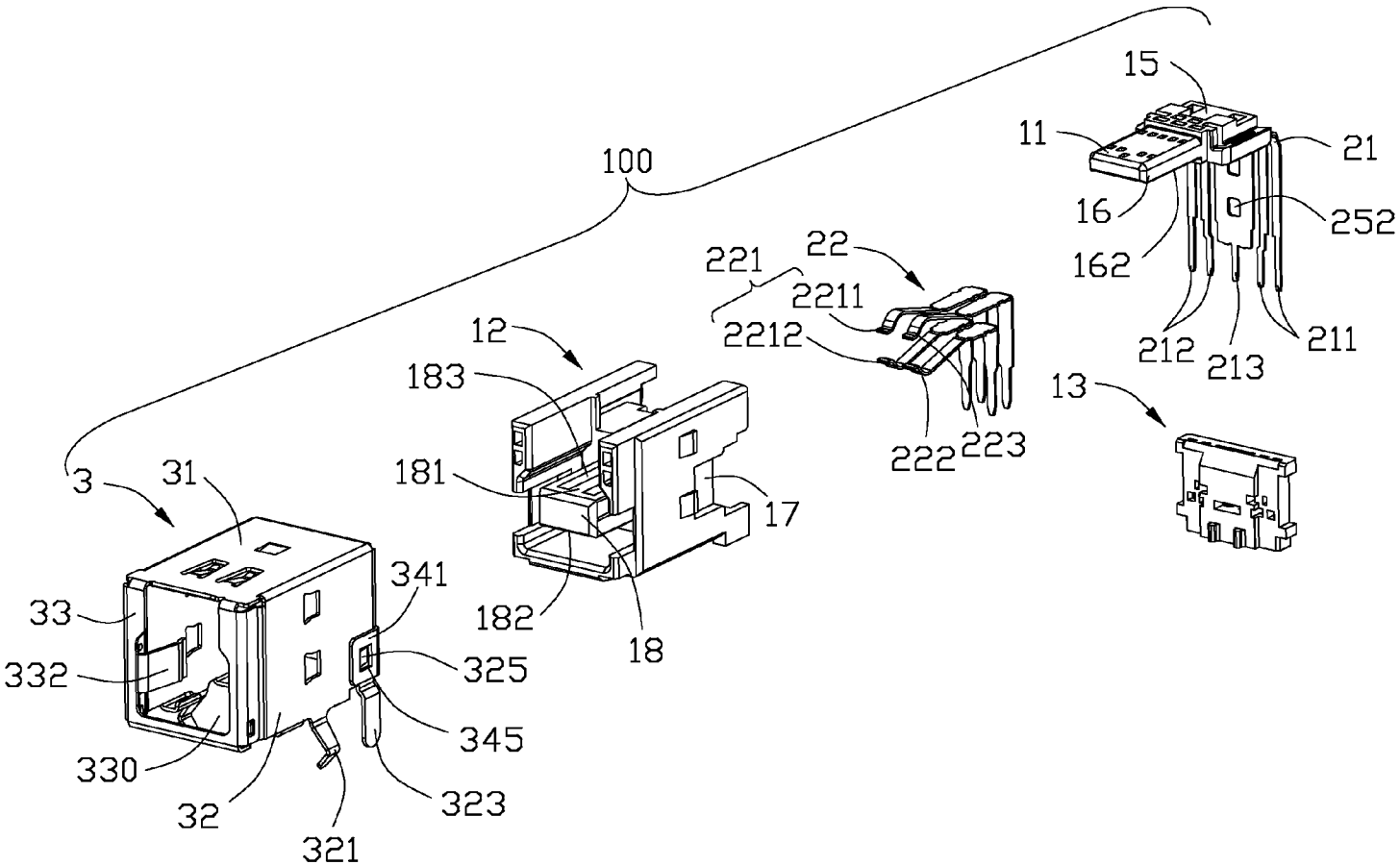
FIG. 3 is an exploded view of the electrical connector according to the present invention.
Figure 4:
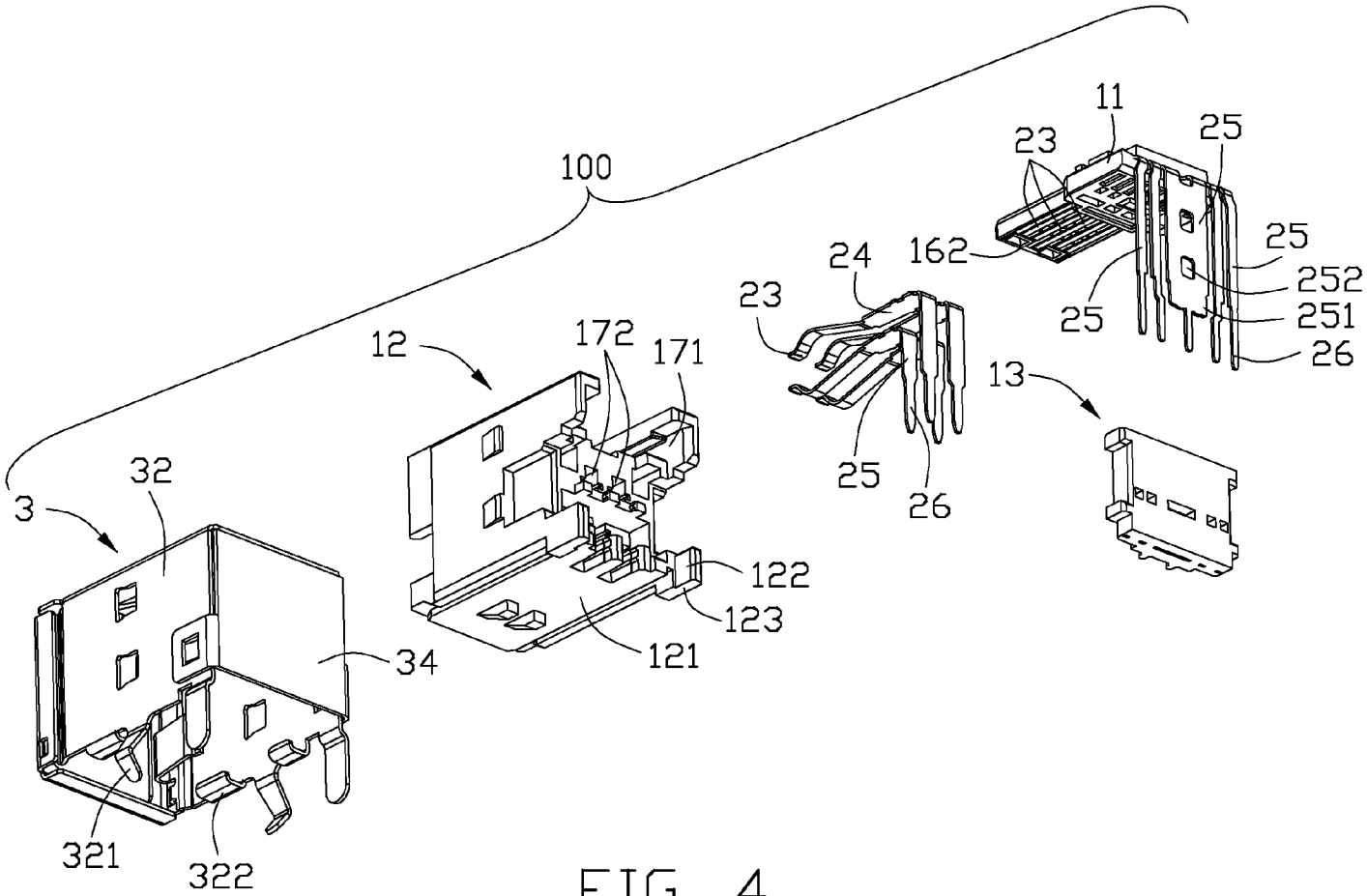
FIG. 4 is a view similar to FIG. 3, while taken from a different aspect.
Figure 5:
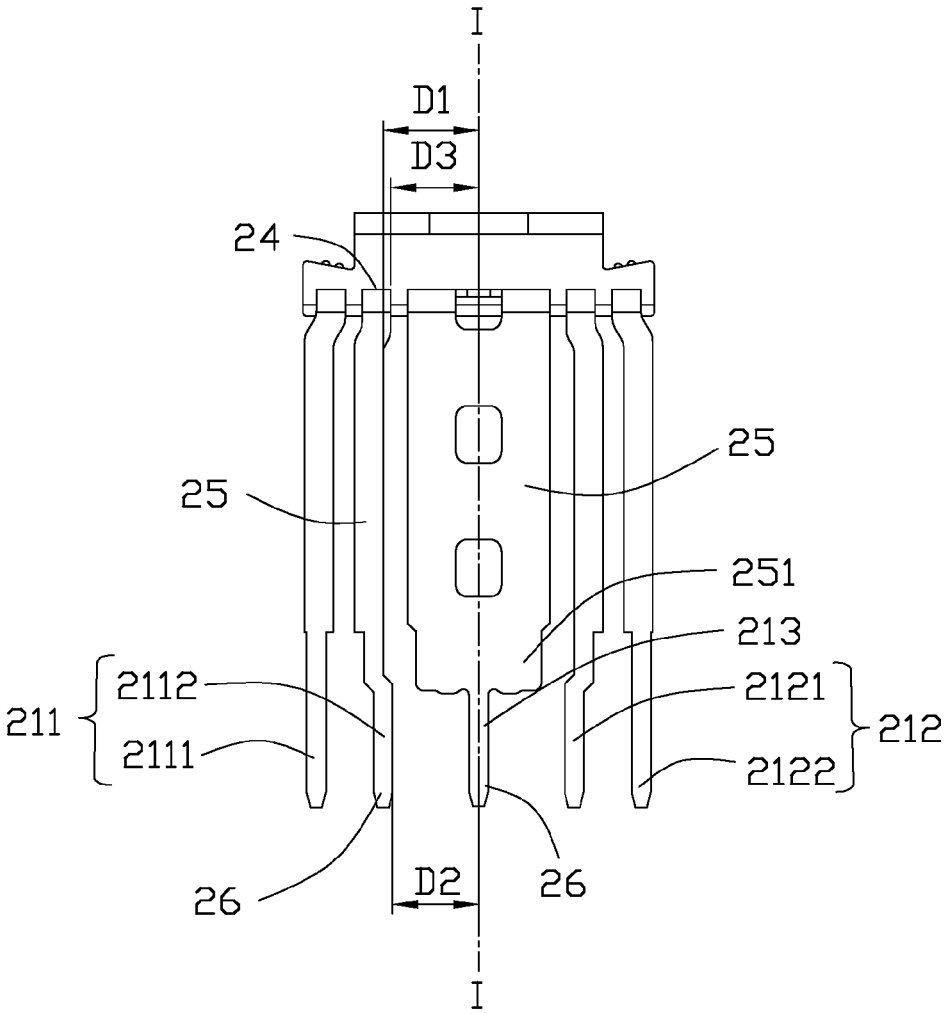
FIG. 5 is a rear elevational view of a plurality of contacts of the electrical connector.
Figure 6:
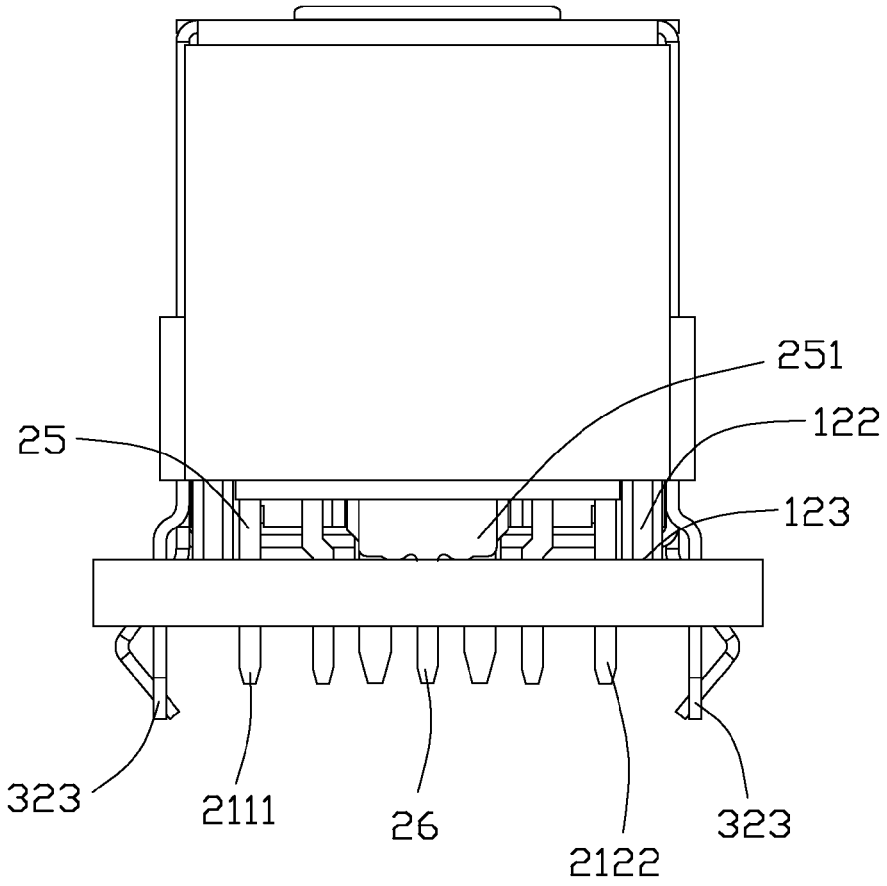
FIG. 6 is a rear elevational view of the electrical connector mounted to the circuit board.

Referring to FIGS. 1-6, an electrical connector 100 for soldering to a printed circuit board 200 according to the present invention, is an USB 3.1 B type receptacle connector which can mate with a standard USB 3.1 B type plug (not shown), a standard USB 3.0 B type plug (not shown) and a standard USB 2.0 B type plug (not shown). The electrical connector 100 comprises an insulative housing 1, a plurality of contacts 2 attached to the insulative housing 1 and a metal shell 3 covering the insulative housing 1.

The insulative housing 1 comprises a first housing 11, a second housing 12 and a spacer 13 assembled together. The second housing 12 defines a mating port 14 (reference to FIG. 1) for receiving the USB 3.0, the USB 3.1 or USB 2.0 B type plugs. The mating port 14 has a first receiving cavity 141 and a second receiving cavity 142 located below the first receiving cavity 141. The first receiving cavity 141 communicates with the second receiving cavity 142 in an upper to down direction and is essentially narrower than the second receiving cavity 142. The first housing 11 has a first base portion 15 and a first tongue 16 integrally extending into the first receiving cavity 141. The first tongue 16 has a mounting surface 162 facing the second housing 12 at a lower side thereof.

The second housing 12 has a second base portion 17 and a second tongue 18 extending into the second receiving cavity 142. The second tongue 18 is parallel to the first tongue 16 and thicker than the first tongue 16 in a vertical direction of the insulative housing 1. The second base portion 17 defines a pair of grooves 171 extending forwardly from a rear and upper end thereof to engage with the first base portion 15 for positioning the first housing 11 to the second housing 12. The second base portion 17 further defines four passageways 172 extending therethrough along an insertion direction of the plugs (reference to FIG. 4). The second tongue 18 has a pair of opposite first and second surface 181, 182, each of which defines a pair of slots 183 extending forwardly from and communicating with the passageways 172 respectively, and the first and second surfaces 181, 182 are upper and lower surfaces of the second tongue 18. The second housing 12 further has a bottom wall 122 in a bottom side of the second base portion 17, two pair of mounting portions 122 protruding downwardly from the bottom wall 122 and a mounting surface 123 formed on the bottom side of the mounting portion 122.

The contacts 2 comprise a plurality of first contacts 21 insert molded in the first housing 11 and a plurality of second contacts 22 assembled in the second housing 12. The second contacts 21 are USB 2.0 contacts and can mates with USB 2.0 plug. The first contact 21 and the second contacts 22 are forming USB 3.0 contacts and can mates with USB 3.0 or USB 3.1 plug. Each contact 2 has a contacting portion 23 at a front end thereof, a position portion 24 connecting with the contacting portion 23, a connecting portion 25 vertically bending from the position portion 24 and a soldering portion 26 extending from the connecting portion 25 out of the insulative housing 1. The contacting portions 23 of the first contacts 21 are disposed on the mounting surface 162 of the first tongue 16. All of the position portions (not labeled) of the first contacts 21 are located in an interface and insert molded in the first base portion 15. All of the connecting portions 25 and soldering portions 26 locate in a vertical interface. All of the connecting portions 25 extend out of the bottom wall 121 of the second housing 12 but not beyond the mounting surface 123 of the mounting portion 122.

The first contacts 21 are arranged in a row in a transverse direction of the insulative housing 1 and comprise a first pair of differential signal contacts 211, a second pair of differential signal contacts 212 and a first grounding contact 213 between said two pairs of the differential signal contacts 211, 212. The first pair of differential signal contacts 211 have a first signal contact 2111 and a second signal contact 2112. The second pair of differential signal contacts 212 have a third signal contact 2121 and a forth signal contact 2122. The first signal contact 2111, the second signal contact 2112, the first grounding contact 213, the third signal contact 2121 and the forth contact 2122 are arranged in turn along the transverse direction and same to the standard USB 3.0 B type connector. The first signal contact 2111 is symmetrical to the forth signal contact 2122 by a center line I-I of the first grounding contact 213. The second signal contact 2112 is also symmetrical to the third signal contact 2121 by the center line I-I. A distance defined between the first and second signal contacts 2111, 2112 is the same to a distance between the third and forth signal contacts 2121, 2122. The first grounding contact 213 is located in a middle of the second signal contact 2112 and the third signal contact 2121. Please refer to FIG. 5, the connecting portions 25 of the first and second signal contacts 2111, 2112 extend laterally and backwardly from a rear end of the position portions 24, and define a first distance D1 between an inner side edge of the second signal contact 2112 and the center line I-I. The first distance D1 is used to enlarge the distance between the two pairs of the differential signal contacts 211, 212 for decreasing crosstalk between the two pair of differential signal contacts 211, 212. The third signal contact 2121 and the forth signal contact 2122 are symmetrical to the first and second single contacts 2111, 2112 by the center line I-I. The soldering portion 26 of the second signal contact 2112 has an inner side edge near the first grounding contact 213. A second distance D2 is defined between the inner side edge of the soldering portion of the second signal contact 2112 and the center line I-I. The second distance D2 is smaller than the first distance D1. The position portion 24 of the second signal contact 2112 defines a third distance D3 between an inner side edge thereof and the center line I-I. The third distance D3 is smaller than the first distance D1. As the electrical connector 100 has a transmit speed twice with regard to the standard USB 3.0 B type connector, the first distance D1 is longer than the second distance D2 and the third distance D3 to reduce a crosstalk between said two pairs of differential signal contacts 211, 212 and assure the transmit speed to suit users.

The connecting portion 23 of the first grounding contact 213 is wider than that of each signal contacts 2111, 2112, 2121, 2122 in the transverse direction to absorb more disturb between the two pair of differential signal contacts 211, 212, and adjust impedance between said two pairs of the differential signal contacts 211, 212 for assuring that the electrical connector 100 has a stable signal transmission. Please refer to FIG. 6, the connecting portion 25 of the first grounding contact 213 further has a strengthen portion 251 extending beyond the bottom wall 121 and extending to the mounting surface 123. A width of the strengthen portion 251 is narrower than other part of the connecting portion 23 but wider than that of the soldering portion 26. The soldering portion 26 extends from a middle end of the strengthen portion 251. The strengthen portion 251 has two tips (not labeled) symmetrical to each by the center line I-I, the two tips are close to a top face of a printed circuit board 200 but does not abut against the printed circuit board 200. In such arrangement, the strengthen portion 251 enhance a profit of grounding and avoid crosstalk between the two pair differential signal contacts 211, 212.

The first housing 11 is insert-molded around all contacting portions 23 and position portions 24 of the first contacts 21. The spacer 13 is insert-molded around all connecting portions 25 of first contacts 21. The connecting portions 25 define a plurality of hollows 252 for positioning. So a plastic flow which forms the first housing 11 can flow into the hollows 252 to limit the first contacts 21 therein. Therefore, the assemble process of the first contacts 21 can be omitted.

The second contacts 22 comprise a power contact 223, a third pair of differential signal contacts 221 and a second grounding contact 222. Each second contact 22 has a position portion 24 retained in the passageways 172 of the second housing 12, a contacting portion 23 extending forwardly from a front end of the position portion 24, a connecting portion 25 extending downwardly from a rear end of the position portion 24 and a soldering portion 26 curvedly extending from a middle end of the connecting portion 25. The third differential signal contacts 221 have a fifth signal contact 2211 and a sixth signal contact 2212. All of the contacting portions 23 of the second contacts 22 are elastic. The contacting portion 23 of the fifth signal contact 2211 and the contacting portion 23 of the power contact 223 are cantileveredly received in the first surface 181 of the second tongue 18, and the contacting portion 23 of the sixth signal contact 2212 and the contacting portion 23 of the second grounding contact 223 are cantileveredly received in the second surface 181 of the second tongue 18. All of the contacting portions 23 of the second contacts 22 protrude into the second receiving cavity 142. The soldering portions 26 of the second contacts 22 are arranged in two rows along the insertion direction and located at a front side of the soldering portions 26 of the first contacts 21.

The contacting portions 23 of the third pair of differential signal contacts 221 are aligned with each other along the upper to down direction. The contacting portion 23 of the power contact 223 and the second grounding contact 222 are aligned with each other along the upper to down direction. Therefore, an arrangement of the contacting portions 23 of the second contacts 23 is same to that of the contacts of standard USB 2.0 B type receptacle and can mate with the USB 2.0 B type plug, and an arrangement of the contacting portions 23 of the first contacts 21 disposed on the first tongue 16 and the contacting portions 23 of the second contacts 22 disposed on the second tongue 18 is same to the arrangement of the contacts of the standard USB 3.0 receptacle and can mate with the USB 3.0 B type plug. Notably, in the instant invention, the contacting portions 23 define essentially a same pitch, i.e., 1.0 mm, along the transverse direction while the soldering portions 26 define a larger pitch, i.e., 2.5 mm, between the grounding contact 213 and the neighboring pair of differential signal contacts 211, and a smaller pitch, i.e., 1.75 mm, between the pair of differential signal contacts 211 itself. Understandably, these pitch arrangements for both the contacting portions 23 and the soldering portions 26 are compliant with the dimensions regulated by the USB 3.0 specification standard.

Please refer to FIGS. 1-6, the metal shell 3 covers the insulative housing 1 to form said mating port 14 together with the tongues 16, 18. The metal shell 3 has a top wall 31, a pair of side walls 32 bending downwardly from two sides of the top wall 31, a mating wall 33 partially covering a front side of the mating port 14 and a rear wall 34 covering a rear side of the insulative housing 1. Each side wall 33 has a first mounting leg 321 extending downwardly from a lower end thereof to mount the electrical connector 100 to the printed circuit board 200, a pair of barbs 322 extending inwardly from a lower end thereof to lock with a lower side of the second housing 12, and a second pair of mounting legs 323 bending backwardly from a back end of the each side walls 32. The mating wall 33 bends downwardly from a front end of the top wall 31 and has a pair of flanges to lock with two side walls 32. The mating wall 33 defines an opening 330 corresponding to the mating port 14. Each side wall 32 defines a pair of slits 325 at a rear side thereof. Two latch strips 341 extending from two side of rear wall 34 each has a pair of projections 345 bending outwardly from upper and lower sides thereof to lock with the slits 325. The two second mounting legs 323 locate at two sides of first pair of differential signal contacts 211 and the second pair of differential signal contacts 212 to reduce cross talk therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector, comprising:

an insulative housing defining a mating port with a first tongue extending thereinto and a base portion assisting the first tongue, the base portion having a bottom wall; and a plurality of first contacts retained in the insulative housing, the first contacts having a first grounding contact and a first pair of differential signal contacts and a second pair of differential signal contacts wherein the first grounding contact is located between the first pair of differential signal contacts and the second pair of differential signal contacts, the first pair of differential signal contacts comprising a first signal contact and a second signal contact located between the first signal contact and the first grounding contact, the second pair of differential signal contacts comprising a third signal contact and a fourth signal contact wherein the third signal contact is located between the fourth signal contact and the first grounding contact, each contact having a contacting portion extending into the mating port, a soldering portion extending downwardly beyond the bottom wall, a position portion extending rearwardly from the contacting portion and a connecting portion extending from the position portion and further downwardly located at a back side of the insulative housing, all the contacting portions disposed in an equal interval;

wherein a first distance is defined between a center line of the first grounding contact and an inner side edge of the connecting portion of the second signal contact, a second distance is defined between the center line and an inner side edge of the soldering portion of the second signal contact, and a third distance is defined between the center line and an inner side edge of the position portion of the second signal contact, and the second distance and the third distance are both smaller than the first distance for decreasing crosstalk between the first pair of differential signal contacts and a second pair of differential signal contacts where the first grounding contact is located;

wherein said housing further forms a second mating tongue in the mating port with a plurality of second contacts therein, the second contacts comprising a power contact, a third pair of differential signal contacts and a second grounding contact, the third pair of differential signal contacts having a fifth signal contact and the sixth signal contact, a contacting portion of the power contact being cantileveredly received in a first surface of the second mating tongue, and a contacting portion of the second contact being cantileveredly received in a second surface of the second mating tongue opposite to said first surface.

2. The electrical connector as claimed in claim 1, wherein the connecting portion of the second signal contact extends laterally and vertically from a rear end of the position portion of the second signal contact, a bottom end of the connecting portion of the second signal contact extends toward the soldering portion of the first grounding contact and the soldering portion of the second signal contact vertically extends from the bottom end of the connecting portion of the second signal contact.

3. The electrical connector as claimed in claim 1, wherein the connecting portions of the second pair of differential signal contacts are symmetrical to the connecting portions of the first pair of differential signal contacts by the center line.

4. The electrical connector as claimed in claim 1, wherein a pitch among the contacting portions of all contacts are same while a pitch among the soldering portions of all contacts varies wherein a distance reflecting said pitch between the soldering portion of the first grounding contact and that of the second signal contact is larger than another distance reflecting said pitch between the soldering portion of the first signal contact and that of the second signal contact.

5. The electrical connector as claimed in claim 4, wherein the distance reflecting the pitch between the soldering portion of the first grounding contact and that of the second signal contact is 2.5 mm while the distance reflecting the pitch between the soldering portion of the first signal contact and that of the second signal contact is 1.75 mm, both said 2.5 mm and said 1.75 mm being regulated in a USB 3.0 standard specification.

6. The electrical connector as claimed in claim 1, wherein the base portion further comprises a mounting portion protruding downwardly from the bottom wall, and a mounting surface formed in a bottom side of the mounting portion, and the first grounding contact further comprises a strengthen portion extending from the connecting portion to the mounting surface, and the soldering portion extends from a middle of a free end of the strength portion.

7. The electrical connector as claimed in claim 6, wherein a width of the strengthen portion is wider than that of the soldering portion but narrower than that of the connecting portion.

8. The electrical connector as claimed in claim 7, wherein the position portion and the connecting portion of the contacts together present as L shaped, and the position portion presents as a level portion extending in an insertion direction and the connecting portion presents as a vertical portion extending downwardly in a vertical direction perpendicular to the insertion direction and the transverse direction.

9. The electrical connector as claimed in claim 7, further comprises a metal shell covering the insulative housing, the shell has a pair of first mounting legs extending beyond the bottom wall of the base portion and a second pair of mounting legs located behind the first mounting legs, each of the second pair of mounting legs is closed to the first signal contact and the forth signal contact, respectively.

10. An electrical connector, comprising:

an insulative housing defining a mating cavity with a first mating tongue extending forwardly in a front-to-back direction;

a plurality of first contacts disposed in the housing and categorized with two pair of differential signal contacts commonly sandwiching a grounding contact therebetween so as to define an inner contact and an outer contact in each pair of differential signal contacts relative to the grounding contact, each of said first contacts defining a front contacting portion for mating with a complementary connector, a rear soldering portion for mounting to a printed circuit board, a position portion and a connecting portion linked to each other and located between the front contacting portion and a rear soldering portion wherein the position portion is linked to the front contacting portion while the connecting portion is linked o the rear soldering portion;

a first pitch among the contacting portions of all first contacts along a transverse direction perpendicular to said front-to-back direction, keeps same while a second pitch among the soldering portions of all first contacts varies wherein a first distance reflecting said second pitch between the soldering portion of the grounding contact and the neighboring pair of differential signal contacts is larger than a second distance reflecting said second pitch between the soldering portions of the respective neighboring pair of differential signal contacts internally;

a third pitch among the connecting portions of all first contacts varies compliantly corresponding to the soldering portions wherein a third distance reflecting said third pitch between the connecting portion of the grounding contact and that of the neighboring pair of differential signal contacts is larger than a fourth distance reflecting said third pitch between the connecting portions of the respective neighboring pair of differential signal contacts; wherein the third distance is larger than the first distance so as to enlarge a fifth distance between the connecting portions of the two corresponding inner contacts of the two pairs of differential signal contacts; and a second mating tongue formed in the mating cavity spaced from said first mating tongue, a plurality of second contacts disposed in the housing corresponding to the second mating tongue and including a power contact, another grounding contact and another pair of differential signal contacts, a contacting portion of the power contact being cantileveredly received in a first surface of the second mating tongue while a contacting portion of said another grounding contact being centileveredly received in a second surface of the second mating tongue opposite to said first surface.

11. The electrical connector as claimed in claim 10, wherein the connecting portion of each of the first contacts wholly lies in a vertical plane perpendicular to said front-to-back direction.

12. The electrical connector as claimed in claim 10, wherein the connecting portion of the inner contact of each of pair of differential signal contacts, is offset outwardly relative to the corresponding position portion and soldering portion of the same first contact.

13. The electrical connector as claimed in claim 10, wherein the first distance is 2.5 mm while the second distance is 1.75 mm, both of which are regulated in a USB 3.0 specification standard.

14. An electrical connector, comprising:

an insulative housing defining a first receiving cavity with a first tongue extending thereinto, the first tongue being assisted by a base portion of the insulative housing, the base portion having a bottom wall in a bottom side of the insulative housing, the base portion forming at least one mounting portions protruding downwardly from the bottom wall and forming a mounting surface on the bottom side of the mounting portion;

a plurality of first contacts being equipped with a first grounding contact and two pairs of differential signal contacts at two sides of said first grounding contact, each first contact having a contacting portion disposed in a same row along a transverse direction of a mating surface of the first tongue, a soldering portion extending downwardly beyond the mounting surface, a horizontal position portion extending rearwardly from the contacting portion and a connecting portion between the position portion and the soldering portion; and wherein a width of the connecting portion of the first grounding contact is wider than that all of the connecting portions of the other first contacts, and the connecting portion of the first grounding contact further has a strengthen portion at a bottom thereof, which extends beyond the bottom wall and extending to the mounting surface, a width of the strengthen portion is wider than that of the soldering portion of each contact;

further including a second receiving cavity with a second tongue extending therein from the base portion, the second receiving cavity communicating with the first receiving cavity in a vertical direction, the second tongue being narrower than the first tongue in said transverse direction while being thicker than the first tongue in the vertical direction in a parallel relation, and a plurality of second contacts disposed on the second tongue, said second contacts including a power contact, another pair of differential signal contacts and a second grounding contact, a contacting portion of the power contact being cantileveredly received in a first surface of the second mating tongue while a contacting portion of said second grounding contact being centileveredly received in a second surface of the second mating tongue opposite to said first surface.

15. The electrical connector as claimed in claim 14, wherein the strengthen portion has two tips symmetrical to each other by a center line of the first grounding contact.

16. The electrical connector as claimed in claim 14, wherein the soldering portion extends from a bottom edge of the strengthen portion along a centerline thereof.

17. The electrical connector as claimed in claim 14, wherein the width of the strengthen portion is dimensionally smaller than that of remaining portions of the connecting portion of the first grounding contact in the transverse direction.

18. The electrical connector as claimed in claim 14, further comprises a metal shell covering the insulative housing, the shell comprises a pair of first mounting legs extending beyond the bottom wall of the base portion and a second pair of mounting legs located behind the first mounting legs and aligned with the soldering portions of the first contacts in the transverse direction.

19. The electrical connector as claimed in claim 14, wherein all contacting portions of the first contacts have a same width and a same pitch therebetween, and the soldering portion and contacting portion of the grounding contact are narrower than the connecting portion thereof in the transverse direction.

* * * * *